US012589930B2

(12) United States Patent
Holley, Jr.

(10) Patent No.: US 12,589,930 B2
(45) Date of Patent: Mar. 31, 2026

(54) CARRIER FOR CONTAINERS

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 110 days.

(21) Appl. No.: 18/243,706

(22) Filed: Sep. 8, 2023

(65) Prior Publication Data

US 2024/0083649 A1 Mar. 14, 2024

Related U.S. Application Data

(60) Provisional application No. 63/405,568, filed on Sep. 12, 2022.

(51) Int. Cl.

| | |
|---|---|
| ***B65D 5/32*** | (2006.01) |
| ***B65B 43/10*** | (2006.01) |
| ***B65D 5/06*** | (2006.01) |
| ***B65D 71/56*** | (2006.01) |
| ***B65D 71/68*** | (2006.01) |

(52) U.S. Cl.

CPC ..... *B65D 71/0081* (2013.01); *B65B 43/10* (2013.01); *B65D 5/064* (2013.01); *B65D 5/32* (2013.01); *B65D 71/0018* (2013.01)

(58) Field of Classification Search

CPC ..... B65D 5/08; B65D 5/064; B65D 71/0081; B65D 71/0085; B65B 43/10

USPC ..... 206/139

See application file for complete search history.

(56) References Cited

U.S. PATENT DOCUMENTS

| | | | |
|---|---|---|---|
| 2,222,211 | A | 11/1940 | Arneson |
| 2,225,822 | A | 12/1940 | Crook |
| 2,227,330 | A | 12/1940 | Turner |
| 2,331,312 | A | 10/1943 | Dorfman |

(Continued)

FOREIGN PATENT DOCUMENTS

| | | |
|---|---|---|
| DE | 90 04 439 | 6/1990 |
| EP | 0 822 150 A1 | 2/1998 |

(Continued)

OTHER PUBLICATIONS

International Search Report and Written Opinion for PCT/US2023/032234 dated Dec. 21, 2023.

*Primary Examiner* — Anthony D Stashick
*Assistant Examiner* — Raven Collins
(74) *Attorney, Agent, or Firm* — Andrew N. Claerbout; FisherBroyles, LLP

(57) ABSTRACT

A carrier for holding a plurality of containers includes a container receiving portion having a plurality of panels extending at least partially around an interior space of the carrier and a plurality of end flaps foldably connected to a respective panel of the plurality of panels. The carrier further includes a handle portion having a plurality of panels and a plurality of end flaps foldably connected to a respective panel of the plurality of panels of the handle portion. At least one end flap of the plurality of end flaps of the handle portion is positioned between at least one side panel and at least one end flap of the plurality of end flaps of the container receiving portion to attach the container receiving portion and the handle portion.

17 Claims, 6 Drawing Sheets

(56) References Cited

U.S. PATENT DOCUMENTS

| | | | |
|---|---|---|---|
| 2,336,857 | A | 12/1943 | Gies et al. |
| 2,457,308 | A | 12/1948 | Hall et al. |
| 2,460,108 | A | 1/1949 | Smith et al. |
| 2,660,361 | A | 11/1953 | Tyrseck |
| 2,689,061 | A | 9/1954 | Gray |
| 2,721,001 | A | 10/1955 | Hasselhoff |
| 2,772,020 | A | 11/1956 | Kramer |
| 2,776,072 | A | 1/1957 | Forrer |
| 2,783,916 | A | 3/1957 | Hodapp |
| 2,991,908 | A | 7/1961 | Conescu |
| 2,993,619 | A | 7/1961 | Arneson |
| 3,029,977 | A | 4/1962 | Arneson |
| 3,053,411 | A | 9/1962 | Struble et al. |
| 3,128,906 | A | 4/1964 | Forrer |
| 3,190,487 | A | 6/1965 | Wood |
| 3,191,800 | A | 6/1965 | Kowal |
| 3,194,478 | A | 7/1965 | Weiss |
| 3,229,849 | A | 1/1966 | Spillson |
| 3,236,414 | A | 2/1966 | Slevin, Jr. |
| 3,313,466 | A | 4/1967 | Keith |
| 3,343,742 | A | 9/1967 | Siegler |
| 3,352,452 | A | 11/1967 | Graser |
| 3,432,073 | A | 3/1969 | Forrer |
| 3,554,401 | A | 1/1971 | Wood |
| 3,624,790 | A | 11/1971 | Stout |
| 3,651,982 | A | 3/1972 | Slevin |
| 3,661,297 | A | 5/1972 | Wood |
| 3,669,306 | A | 6/1972 | Forrer |
| 3,672,539 | A | 6/1972 | Forrer |
| 3,709,400 | A | 1/1973 | Arneson |
| 3,721,335 | A | 3/1973 | Grant |
| 3,722,738 | A | 3/1973 | Wright |
| 3,739,940 | A | 6/1973 | Harrelson |
| 3,754,680 | A | 8/1973 | Wood |
| 3,757,991 | A | 9/1973 | Stout |
| 3,784,053 | A | 1/1974 | Stout |
| 3,860,113 | A | 1/1975 | Helms |
| 3,893,565 | A | 7/1975 | Rossi et al. |
| 3,917,059 | A | 11/1975 | Wood |
| 3,917,060 | A | 11/1975 | Wood |
| 3,917,061 | A | 11/1975 | Stout |
| 4,000,813 | A | 1/1977 | Stout |
| 4,010,847 | A | 3/1977 | Wood et al. |
| 4,029,205 | A | 6/1977 | Wood |
| 4,153,158 | A | 5/1979 | Graser et al. |
| 4,171,046 | A | 10/1979 | Bonczyk |
| 4,187,944 | A | 2/1980 | Wood |
| 4,205,748 | A | 6/1980 | Wilson |
| 4,217,983 | A | 8/1980 | Stout |
| 4,243,138 | A | 1/1981 | Wilson |
| 4,250,992 | A | 2/1981 | Gilbert |
| 4,253,564 | A | 3/1981 | Engdahl, Jr. |
| 4,308,950 | A | 1/1982 | Wood |
| 4,318,470 | A | 3/1982 | Montealegre |
| 4,319,682 | A | 3/1982 | Wright et al. |
| 4,362,240 | A | 12/1982 | Elward |
| 4,374,561 | A | 2/1983 | Stout et al. |
| 4,377,252 | A | 3/1983 | Schillinger |
| 4,406,365 | A | 9/1983 | Kulig |
| 4,413,729 | A | 11/1983 | Wood |
| 4,450,956 | A | 5/1984 | Wood |
| 4,469,222 | A | 9/1984 | Graser |
| 4,480,746 | A | 11/1984 | Wood |
| 4,482,055 | A | 11/1984 | Boyle |
| 4,509,640 | A | 4/1985 | Joyce |
| 4,544,092 | A | 10/1985 | Palmer |
| 4,591,090 | A | 5/1986 | Collins et al. |
| 4,610,349 | A | 9/1986 | Schwartz et al. |
| 4,722,437 | A | 2/1988 | Walsh |
| 4,770,294 | A | 9/1988 | Graser |
| 4,782,943 | A | 11/1988 | Blackman |
| 4,782,944 | A | 11/1988 | Engdahl, Jr. |
| 4,792,038 | A | 12/1988 | Cooper |
| 4,927,009 | A | 5/1990 | Stout |
| 5,029,698 | A | 7/1991 | Stout |
| 5,040,672 | A | 8/1991 | DeMaio et al. |
| 5,072,876 | A | 12/1991 | Wilson |
| 5,123,588 | A | 6/1992 | Harris |
| 5,161,732 | A | 11/1992 | Clein et al. |
| 5,167,325 | A | 12/1992 | Sykora |
| 5,191,976 | A | 3/1993 | Stout et al. |
| 5,246,113 | A | 9/1993 | Schuster |
| 5,282,348 | A | 2/1994 | Dampier et al. |
| 5,359,830 | A | 11/1994 | Olson et al. |
| 5,363,954 | A | 11/1994 | Dampier et al. |
| 5,400,901 | A | 3/1995 | Harrelson |
| 5,439,110 | A | 8/1995 | Regan, II |
| 5,458,234 | A | 10/1995 | Harris |
| 5,482,203 | A | 1/1996 | Stout |
| 5,484,053 | A | 1/1996 | Harris |
| 5,499,712 | A | 3/1996 | Harrelson |
| 5,518,110 | A | 5/1996 | Harrelson |
| 5,531,319 | A | 7/1996 | Harrelson |
| 5,538,130 | A | 7/1996 | Harrelson |
| 5,538,131 | A | 7/1996 | Harrelson |
| 5,547,074 | A | 8/1996 | Plaxico et al. |
| 5,579,625 | A | 12/1996 | Olson et al. |
| 5,590,762 | A | 1/1997 | Harrelson |
| 5,593,027 | A | 1/1997 | Sutherland |
| 5,611,425 | A | 3/1997 | Holley, Jr. |
| 5,620,094 | A | 4/1997 | Naumann |
| 5,638,956 | A | 6/1997 | Sutherland |
| 5,645,162 | A | 7/1997 | Harrelson |
| 5,649,620 | A | 7/1997 | Harrelson |
| 5,657,864 | A | 8/1997 | Harrelson |
| 5,657,865 | A | 8/1997 | Harrelson |
| 5,680,930 | A | 10/1997 | Stone |
| 5,682,982 | A | 11/1997 | Stonehouse |
| 5,682,985 | A | 11/1997 | Plaxico et al. |
| 5,695,051 | A | 12/1997 | Hart |
| 5,709,298 | A | 1/1998 | Harris |
| 5,765,685 | A | 6/1998 | Roosa |
| 5,775,487 | A | 7/1998 | Harrelson |
| 5,819,920 | A | 10/1998 | Sutherland |
| 5,848,695 | A | 12/1998 | Harris et al. |
| 5,855,316 | A | 1/1999 | Spivey |
| 5,871,090 | A | 2/1999 | Doucette et al. |
| 5,878,877 | A | 3/1999 | Sutherland |
| 5,884,756 | A | 3/1999 | Holley, Jr. et al. |
| 5,941,377 | A | 8/1999 | Hart et al. |
| 5,947,273 | A | 9/1999 | Dalrymple et al. |
| 6,003,665 | A | 12/1999 | Stout |
| 6,041,920 | A | 3/2000 | Hart et al. |
| 6,112,977 | A | 9/2000 | Sutherland et al. |
| 6,131,729 | A | 10/2000 | Eckermann et al. |
| 6,155,962 | A | 12/2000 | Dalrymple et al. |
| 6,168,013 | B1 | 1/2001 | Gomes |
| 6,230,881 | B1 | 5/2001 | Collura |
| 6,247,585 | B1 | 6/2001 | Holley, Jr. |
| 6,315,111 | B1 | 11/2001 | Sutherland |
| 6,321,906 | B1 | 11/2001 | Wein |
| 6,341,689 | B1 | 1/2002 | Jones |
| 6,371,287 | B1 | 4/2002 | Jones et al. |
| 6,571,941 | B2 | 6/2003 | Holley, Jr. |
| 6,695,137 | B2 | 2/2004 | Jones et al. |
| 6,736,260 | B2 | 5/2004 | Gomes et al. |
| 6,802,802 | B2 | 10/2004 | Woog |
| 6,814,228 | B2 | 11/2004 | Sutherland |
| 6,938,756 | B2 | 9/2005 | Schuster |
| 7,011,209 | B2 | 3/2006 | Sutherland et al. |
| 7,025,197 | B2 | 4/2006 | Sutherland |
| 7,070,045 | B2 | 7/2006 | Theelen |
| 7,128,206 | B2 | 10/2006 | Kohler |
| 7,134,547 | B2 | 11/2006 | Auclair |
| 7,207,934 | B2 | 4/2007 | Schuster |
| 7,234,596 | B2 | 6/2007 | Lebras |
| 7,374,038 | B2 | 5/2008 | Smalley |
| 7,448,492 | B2 | 11/2008 | Sutherland |
| 7,472,791 | B2 | 1/2009 | Spivey, Sr. |
| 7,552,820 | B2 | 6/2009 | Kohler |
| 7,604,116 | B2 | 10/2009 | Schuster |
| 7,644,817 | B2 | 1/2010 | Sutherland |
| 7,677,387 | B2 | 3/2010 | Brand et al. |
| 7,762,395 | B2 | 7/2010 | Sutherland et al. |

(56) References Cited

U.S. PATENT DOCUMENTS

| | | | | |
|---|---|---|---|---|
| 7,762,397 | B2 | 7/2010 | Coltri-Johnson et al. | |
| 7,793,780 | B2 | 9/2010 | Smalley | |
| 7,959,062 | B2 | 6/2011 | Auclair | |
| 8,020,695 | B2 | 9/2011 | Brand | |
| 8,297,437 | B2 | 10/2012 | Smalley et al. | |
| 8,622,207 | B2 | 1/2014 | Smalley | |
| 9,415,914 | B2 | 8/2016 | Holley, Jr. | |
| 10,301,090 | B2 | 5/2019 | Holley, Jr. | |
| 10,543,969 | B2 | 1/2020 | Gonzalez et al. | |
| 10,766,680 | B2 | 9/2020 | Holley, Jr. | |
| 11,492,185 | B2 | 11/2022 | Zammit et al. | |
| 11,548,708 | B2 | 1/2023 | Holley, Jr. | |
| 12,037,173 | B2 | 7/2024 | Smalley | |
| 12,172,814 | B2 | 12/2024 | Smalley | |
| 2002/0077236 | A1 | 6/2002 | Chalendar et al. | |
| 2002/0117407 | A1 | 8/2002 | Holley | |
| 2003/0111363 | A1 | 6/2003 | Theelen | |
| 2003/0159950 | A1 | 8/2003 | Jones et al. | |
| 2003/0213705 | A1 | 11/2003 | Woog | |
| 2004/0026269 | A1 | 2/2004 | Cuomo | |
| 2004/0050722 | A1 | 3/2004 | Schuster | |
| 2004/0094435 | A1 | 5/2004 | Auclair et al. | |
| 2005/0167292 | A1 | 8/2005 | Sutherland | |
| 2005/0211577 | A1 | 9/2005 | Bakx | |
| 2005/0218014 | A1 | 10/2005 | Schuster | |
| 2005/0230273 | A1 | 10/2005 | Kohler | |
| 2006/0091024 | A1 | 5/2006 | Cuomo | |
| 2006/0148629 | A1* | 7/2006 | Cuomo | B65D 71/0014 206/170 |
| 2006/0157545 | A1 | 7/2006 | Auclair | |
| 2006/0231440 | A1 | 10/2006 | Holley, Jr. | |
| 2007/0000980 | A1 | 1/2007 | Oliveira | |
| 2007/0017839 | A1 | 1/2007 | Sutherland | |
| 2007/0029212 | A1 | 2/2007 | Smalley | |
| 2007/0151873 | A1 | 7/2007 | Schuster | |
| 2008/0210581 | A1 | 9/2008 | Brand | |
| 2008/0265008 | A1 | 10/2008 | Holley | |
| 2009/0008273 | A1 | 1/2009 | Smalley | |
| 2010/0006458 | A1 | 1/2010 | Wilkins et al. | |
| 2010/0072086 | A1 | 3/2010 | Smalley | |
| 2011/0048975 | A1 | 3/2011 | Brand | |
| 2012/0000913 | A1 | 1/2012 | Smalley et al. | |
| 2014/0291386 | A1 | 10/2014 | Ikeda | |
| 2016/0311593 | A1 | 10/2016 | Eckermann | |
| 2017/0247137 | A1* | 8/2017 | Gaidaeva | B65D 71/36 |
| 2020/0189806 | A1 | 6/2020 | Sill et al. | |

FOREIGN PATENT DOCUMENTS

| | | |
|---|---|---|
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| KR | 10-0935075 B1 | 12/2009 |
| KR | 10-2017-0129365 A | 11/2017 |
| WO | WO 97/05026 | 2/1997 |
| WO | WO 99/01356 | 1/1999 |
| WO | WO 2006/020525 | 2/2006 |
| WO | WO 2008/089124 | 7/2008 |
| WO | WO 2022/036020 A1 | 2/2022 |

* cited by examiner

CARRIER FOR CONTAINERS

CROSS-REFERENCE TO RELATED APPLICATION

This application claims the benefit of U.S. Provisional Patent Application No. 63/405,568, filed on Sep. 12, 2022.

INCORPORATION BY REFERENCE

The entire disclosure of U.S. Provisional Patent Application No. 63/425,568, filed on Sep. 12, 2022, is hereby incorporated for all purposes as if presented herein in its entirety.

BACKGROUND OF THE DISCLOSURE

The present disclosure generally relates to carriers or cartons for holding and displaying containers. More specifically, the present disclosure relates to basket-style carriers for holding and displaying containers.

SUMMARY OF THE DISCLOSURE

According to one aspect, the disclosure is generally directed to a carrier for holding a plurality of containers, the carrier comprising a container receiving portion, the container receiving portion comprising a plurality of panels extending at least partially around an interior space of the carrier and a plurality of end flaps foldably connected to a respective panel of the plurality of panels, the plurality of panels of the container receiving portion comprising a bottom panel, a front panel, a back panel, and at least one side panel. The carrier further comprises a handle portion, the handle portion comprising a plurality of panels and a plurality of end flaps foldably connected to a respective panel of the plurality of panels of the handle portion, the plurality of panels of the handle portion comprising a front handle panel and a back handle panel, at least one end flap of the plurality of end flaps of the handle portion is positioned between the at least one side panel and at least one end flap of the plurality of end flaps of the container receiving portion to attach the container receiving portion and the handle portion.

According to another aspect, the disclosure is generally directed to a combination of blanks for forming a carrier for holding a plurality of containers, the combination comprising a container blank for forming a container receiving portion extending around an interior space of the carrier formed from the container blank and the handle blank, the container blank comprising a plurality of panels and a plurality of end flaps foldably connected to a respective panel of the plurality of panels, the plurality of panels of the container blank comprising a bottom panel, a front panel, a back panel, and at least one side panel. The combination further comprises a handle blank for forming a handle portion of the carrier formed from the container blank and the handle blank, the handle blank comprising a plurality of panels and a plurality of end flaps foldably connected to a respective panel of the plurality of panels of the handle blank, the plurality of panels of the handle blank comprising a front handle panel and a back handle panel, at least one end flap of the plurality of end flaps of the handle blank is for being positioned between the at least one side panel and at least one end flap of the plurality of end flaps of the container blank to attach the container receiving portion and the handle portion when the carrier is formed from the container blank and the handle blank.

According to another aspect, the disclosure is generally directed to a method of forming a carrier for holding a plurality of containers, the method comprising obtaining a container blank, the container blank comprising a plurality of panels and a plurality of end flaps foldably connected to a respective panel of the plurality of panels, the plurality of panels of the container receiving blank comprising a bottom panel, a front panel, a back panel, and at least one side panel. The method further comprises obtaining a handle blank, the handle blank comprising a plurality of panels and a plurality of end flaps foldably connected to a respective panel of the plurality of panels of the handle blank, the plurality of panels of the handle blank comprising a front handle panel and a back handle panel. The method further comprises forming a container receiving portion of the carrier from the container blank, comprising positioning the plurality of panels of the container blank extending at least partially around an interior space of the carrier, and forming a handle portion of the carrier from the handle blank, comprising positioning at least one end flap of the plurality of end flaps of the handle portion between the at least one side panel and at least one end flap of the plurality of end flaps of the container receiving portion to attach the container receiving portion and the handle portion.

According to another aspect, the disclosure is generally directed to a package, the package comprising a plurality of containers and a carrier holding the plurality of containers. The carrier comprises a container receiving portion, the container receiving portion comprising a plurality of panels extending at least partially around an interior space of the carrier and a plurality of end flaps foldably connected to a respective panel of the plurality of panels, the plurality of panels of the container receiving portion comprising a bottom panel, a front panel, a back panel, and at least one side panel. The carrier further comprises a handle portion, the handle portion comprising a plurality of panels and a plurality of end flaps foldably connected to a respective panel of the plurality of panels of the handle portion, the plurality of panels of the handle portion comprising a front handle panel and a back handle panel, at least one end flap of the plurality of end flaps of the handle portion is positioned between the at least one side panel and at least one end flap of the plurality of end flaps of the container receiving portion to attach the container receiving portion and the handle portion.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments. In this specification, the terms "lower," "bottom," "upper," "top," "front," and "back" indicate orientations determined in relation to fully erected carriers.

As described herein, cartons can be formed by multiple overlapping panels, portions, and/or end flaps. Such panels, portions, and/or end flaps can be designated in relative terms to one another, e.g., "first", "second", "third", etc., in sequential or non-sequential reference, without departing from the disclosure.

Figure 1:
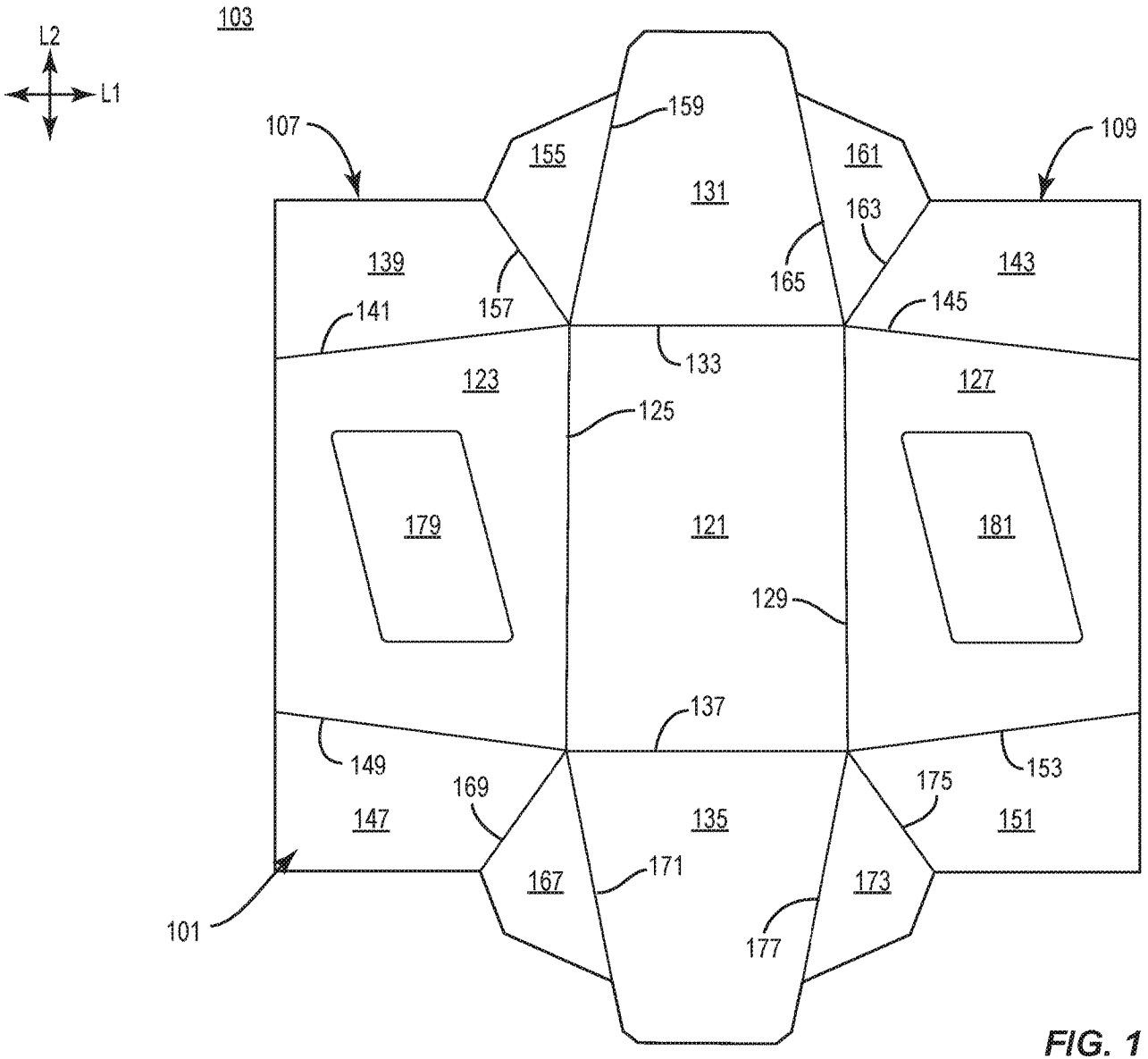
FIG. 1 is a plan view of an exterior surface of a blank for forming a handle portion of a carrier according to an exemplary embodiment of the disclosure.
Figure 6:
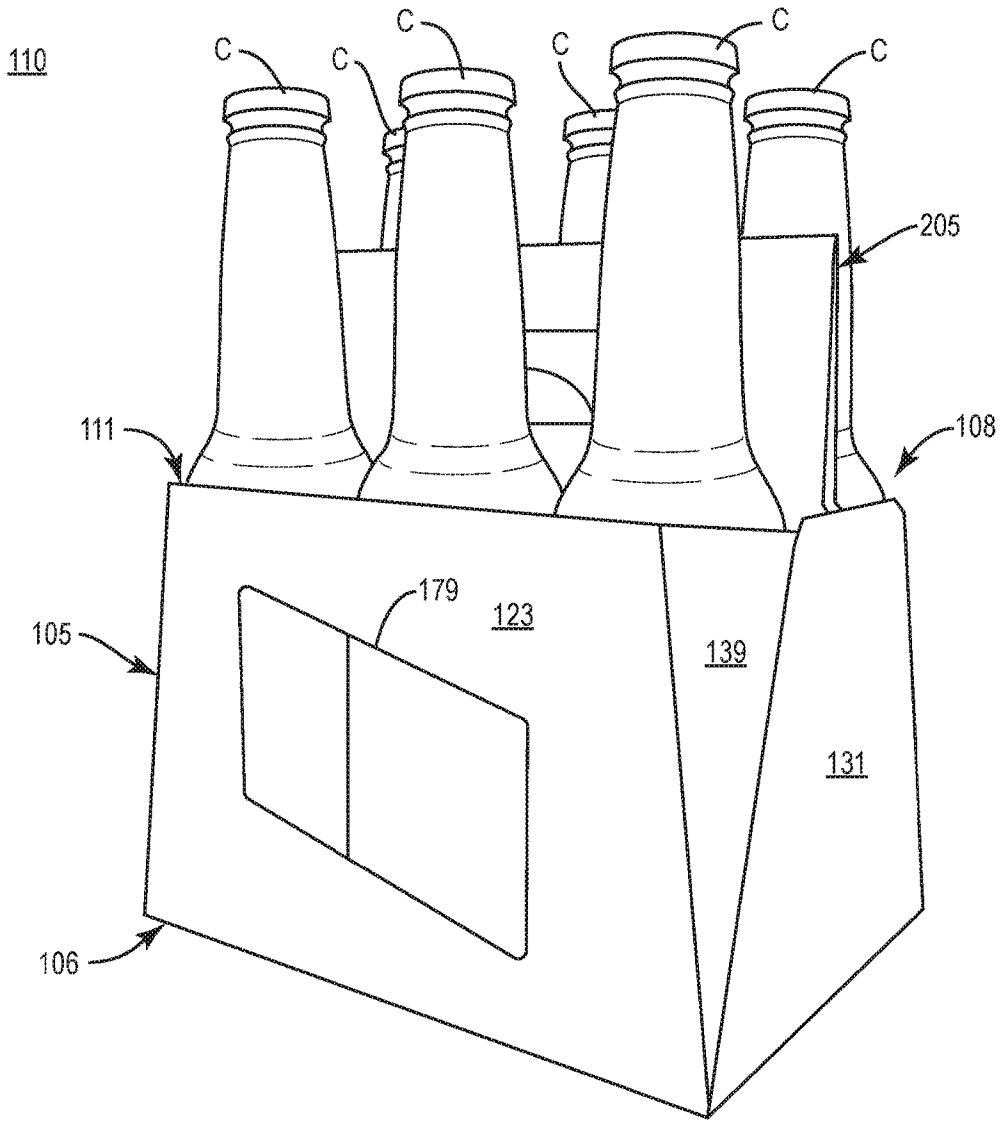
FIG. 6 is a perspective view of a carrier formed from the blanks of FIGS. 1 and 2 according to an exemplary embodiment of the disclosure.

FIG. 1 shows a plan view of the exterior side 101 of a container blank 103 used to form a container receiving portion 105 of a carrier package or basket-style carrier 110 (FIG. 6), in accordance with an exemplary embodiment of the present disclosure. As shown in FIG. 6, the carrier 110 is sized to contain six containers C, three containers C being contained in a front portion 106 of the carrier 110 and three containers C being contained in a back portion 108 of the carrier 110. As described herein, the carrier 110 can be provided with one or more containers C to form a package.

In the illustrated embodiment, the containers C can be beverage bottles, but the containers C could be any other suitable type and size of container without departing from the disclosure. The carrier 110 can be sized and shaped to hold more or less than six containers C. In one embodiment, the front portion 106 and the back portion 108 of the carrier 105 each have three containers C. In other embodiments, the front portion 106 and the back portion 108 of the carrier 110 can hold more or less than three containers C without departing from the disclosure.

As illustrated in FIG. 1, the container blank 103 has a longitudinal axis L1 and a lateral axis L2. The container blank 103 can have a front portion 107 for at least partially forming the front portion 106 of the carrier 110, and a back portion 109 for at least partially forming the back portion 108 of the carrier 110.

In the illustrated embodiment, the container blank 103 and container receiving portion 105 formed therefrom includes a plurality of panels for extending at least partially around an interior space 111 of the carrier 110 at least partially formed from the blank 103 and that includes a bottom panel 121, a front panel 123 foldably connected to the bottom panel 121 at a lateral fold line 125, a back panel 127 foldably connected to the bottom panel 121 at a lateral fold line 129, a first side panel 131 foldably connected to the bottom panel 121 at a longitudinal fold line 133, and a second side panel 135 foldably connected to the bottom panel 121 at a longitudinal fold line 137.

The container blank 103 and container receiving portion 105 formed therefrom can include a plurality of end flaps foldably connected to a respective panel of the plurality of panels. The plurality of end flaps can include a side end flap 139 (broadly, "first side end flap" or "second side end flap") foldably connected to the front panel 123 at an oblique fold line 141, a side end flap 143 (broadly, "first side end flap" or "second side end flap") foldably connected to the back panel 127 at an oblique fold line 145, a side end flap 147 (broadly, "first side end flap" or "second side end flap") foldably connected to the front panel 123 at an oblique fold line 149, and a side end flap 151 (broadly, "first side end flap" or "second side end flap") foldably connected to the back panel 127 at an oblique fold line 153.

Furthermore, the container blank 103 and container receiving portion 105 formed therefrom can include a plurality of gusset panels or gusset flaps foldably connected to a respective panel of the plurality of panels and a respective end flap of the plurality of end flaps. A gusset panel or gusset flap 155 (broadly, "first gusset flap" or "second gusset flap") can be foldably connected to the end flap 139 at an oblique fold line 157 and to the side panel 131 at an oblique fold line 159. A gusset panel or gusset flap 161 (broadly, "first gusset flap" or "second gusset flap") can be foldably connected to the end flap 143 at an oblique fold line 163 and to the side panel 131 at an oblique fold line 165. Similarly, a gusset panel or gusset flap 167 (broadly, "first gusset flap" or "second gusset flap") can be foldably connected to the end flap 147 at an oblique fold line 169 and to the side panel 135 at an oblique fold line 171, and a gusset panel or gusset flap 173 (broadly, "first gusset flap" or "second gusset flap") can be foldably connected to the end flap 151 at an oblique fold line 175 and to the side panel 135 at an oblique fold line 177. In some embodiments, one or more of the gusset flaps 155, 161, 167, 173 can be an end flap of the plurality of end flaps.

The container blank 103 and container receiving portion 105 formed therefrom can also include product visibility features for facilitating viewing of one or more portions of the interior space 111 of the container receiving portion 105/carrier 110 formed from the blank 103. Product visibility features can include an opening 179 in the side panel 123 and an opening 181 in the side panel 127. While the openings 179, 181 are illustrated as generally parallelogram-shaped/rhomboid in profile, it will be understood that one or both of the openings 179, 181 can have a different configuration without departing from the disclosure.

Figure 2:
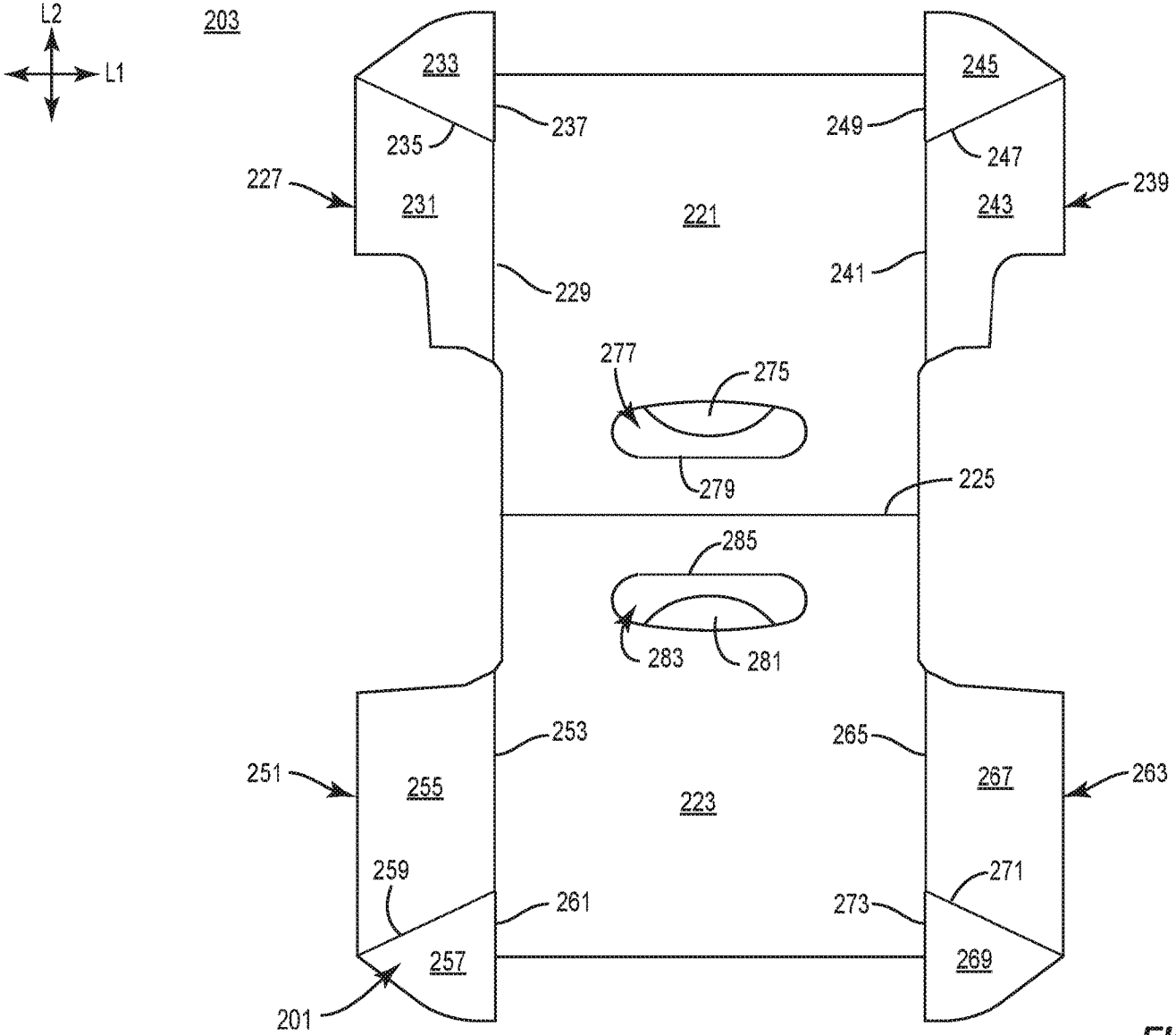
FIG. 2 is a plan view of an exterior surface of a blank for forming a container receiving portion of a carrier according to an exemplary embodiment of the disclosure.

Turning to FIG. 2, the exterior surface 201 of a handle blank 203 is illustrated. The handle blank 203 is for forming a handle portion 205 of the carrier 110 such that the container blank 103/container receiving portion 105 cooperates with the handle blank 203/handle portion 205 to form the carrier 110.

The handle blank 203 can have the longitudinal axis L1 and the longitudinal axis L2, and a plurality of panels that includes a front central panel or front handle panel 221 foldably connected to a back central panel or back handle panel 223 at a longitudinal fold line 225.

The handle blank 203 can also include a plurality of end flaps foldably connected to a respective panel of the plurality of panels. The plurality of end flaps can include a first front attachment end flap 227 foldably connected to the front handle panel 221 at a lateral fold line 229. The front attachment end flap 227 can include a base portion 231 foldably connected to the front handle panel 221 at the lateral fold line 229, and a distal portion 233 foldably connected to the base portion 231 at an oblique fold line 235. The distal portion 233 of the attachment end flap 227 can be separable from the front handle panel 221 at a lateral cut 237 that is collinear with the fold line 229.

A second front attachment end flap 239 can be foldably connected to the front handle panel 221 at a lateral fold line 241. The front attachment end flap 239 can include a base portion 243 foldably connected to the front handle panel 221 at the lateral fold line 241, and a distal portion 245 foldably connected to the base portion 243 at an oblique fold line 247. The distal portion 245 of the attachment end flap 239 can be separable from the front handle panel 221 at a lateral cut 249 that is collinear with the fold line 241.

Similarly, a first back attachment end flap 251 can be foldably connected to the back handle panel 223 at a lateral fold line 253. The back attachment end flap 251 can include a base portion 255 foldably connected to the back handle panel 223 at the lateral fold line 253, and a distal portion 257 foldably connected to the base portion 255 at an oblique fold line 259. The distal portion 257 of the attachment end flap 251 can be separable from the back handle panel 223 at a lateral cut 261 that is collinear with the fold line 253.

A second back attachment end flap 263 can be foldably connected to the back handle panel 223 at a lateral fold line 265. The back attachment end flap 263 can include a base portion 267 foldably connected to the back handle panel 223 at the lateral fold line 265, and a distal portion 269 foldably connected to the base portion 267 at an oblique fold line 271. The distal portion 269 of the attachment end flap 263 can be separable from the back handle panel 223 at a lateral cut 273 that is collinear with the fold line 265.

The handle blank 203 and the handle portion 205 formed therefrom can also include handle features for forming a handle 207 of the handle portion 207/carrier 110. The handle features can include a front handle opening 275 at least partially defined in the front handle panel 221 and a handle flap 277 foldably connected to the handle panel 221 at a longitudinal fold line 279 and positioned extending at least partially into the handle opening 275. A back handle opening 281 can be at least partially defined in the back handle panel 223 and a handle flap 283 can be foldably connected to the back handle panel 223 at a longitudinal fold line 285 and positioned extending at least partially into the handle opening 281.

The handle features of the blank 203/handle portion 205 can include one or more of the handle openings 273, 279 and associated features, handle flaps 275, 281 and associated features, and upper portions of the handle panels 221, 223.

Figure 3:
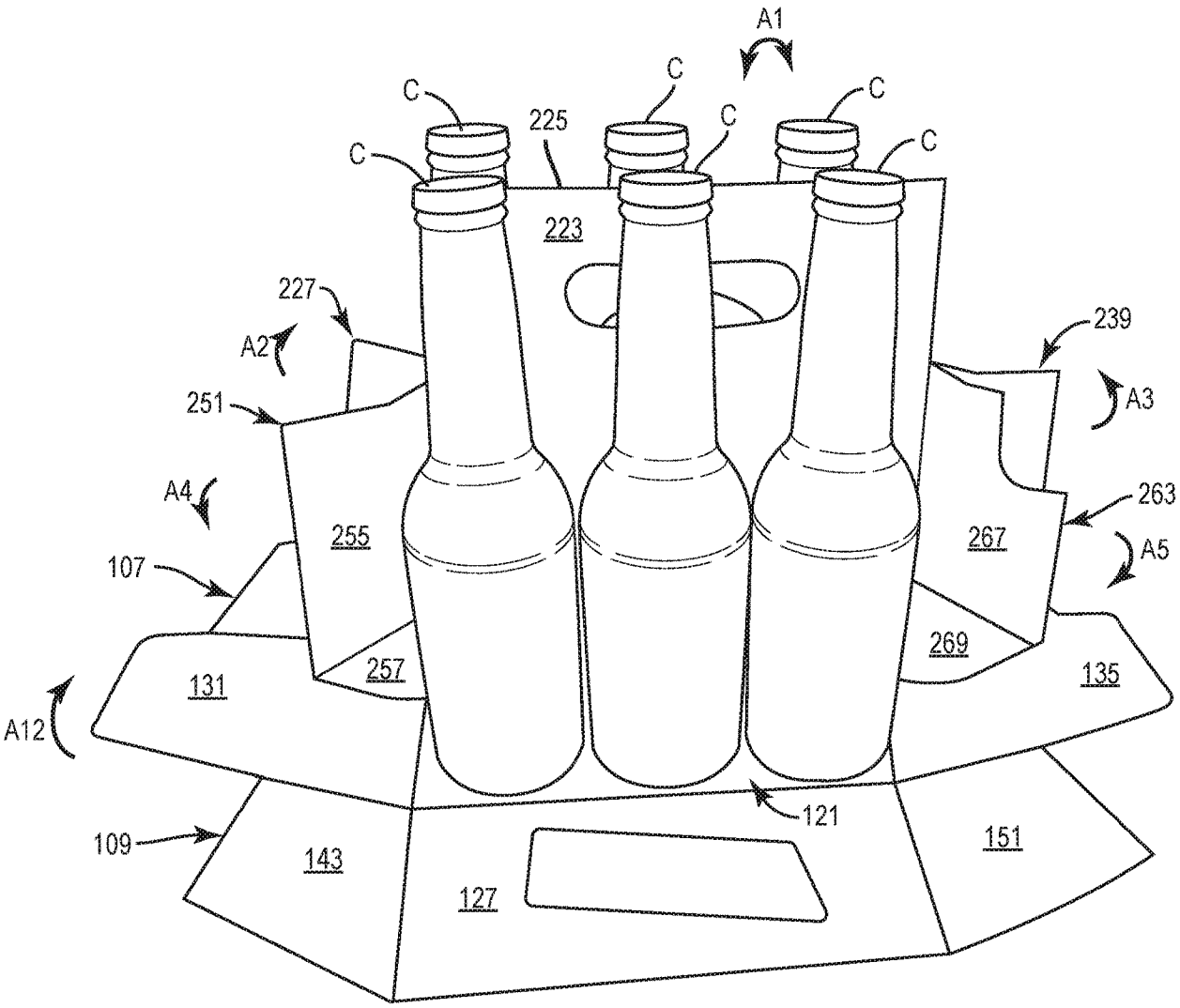
FIGS. 3-5 are sequential perspective views of a formation of a carrier from the blanks of FIGS. 1 and 2 according to an exemplary embodiment of the disclosure.
Figure 4:
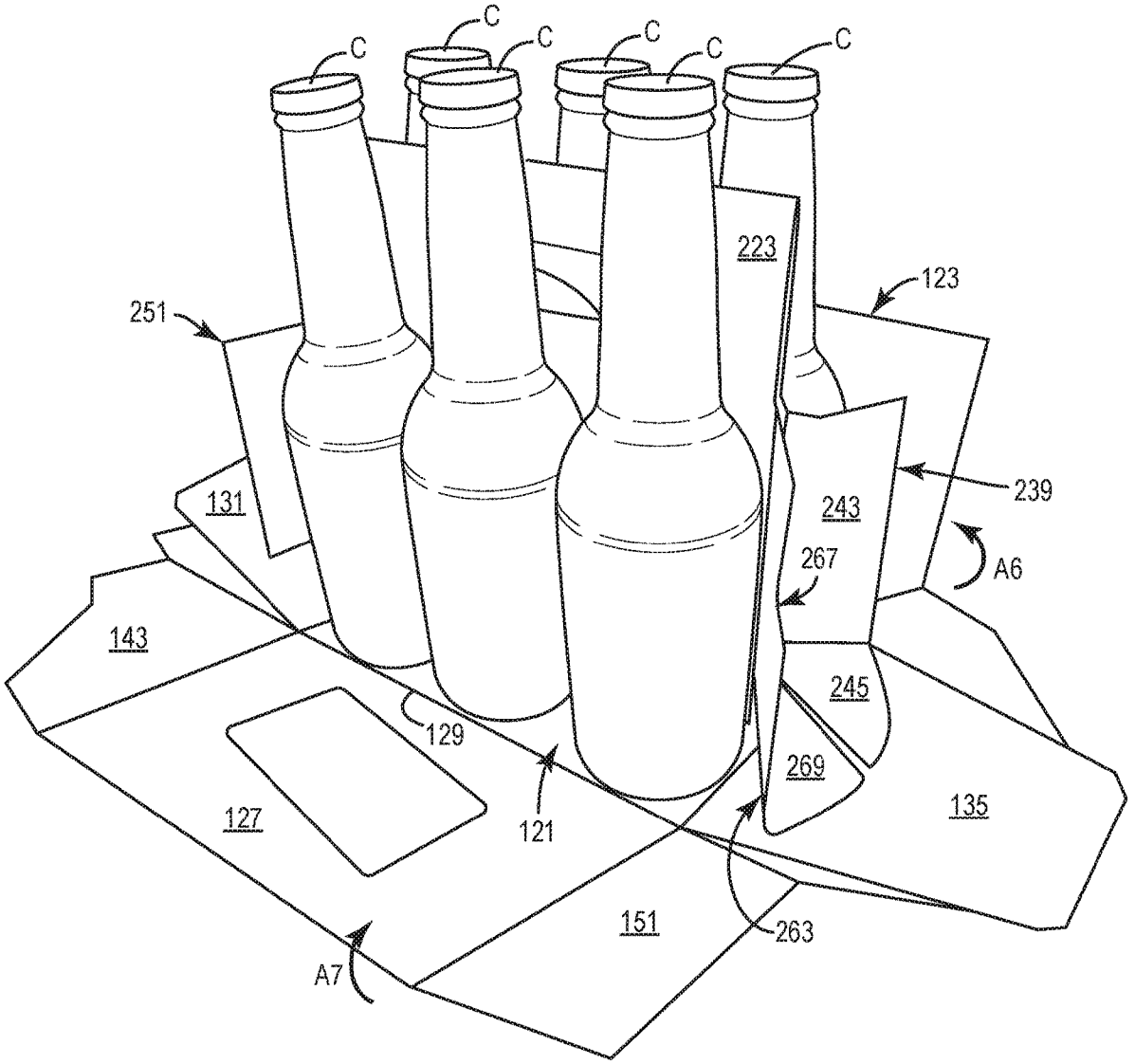
Figure 5:
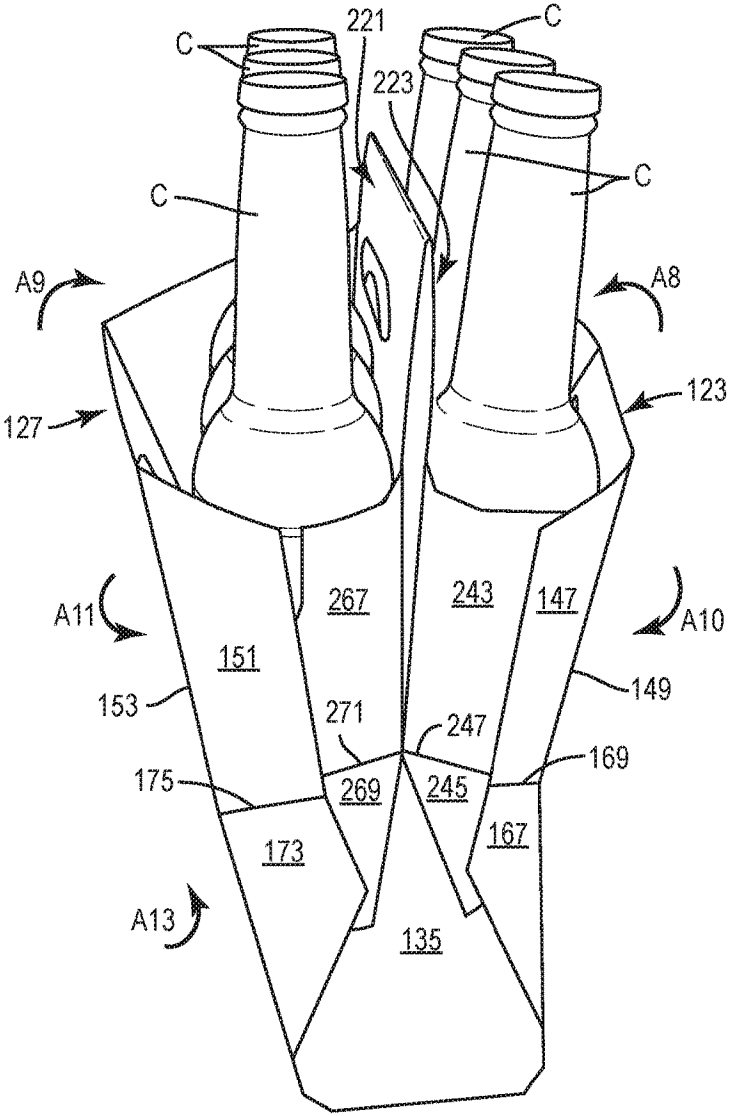

Turning to FIGS. 3-5, formation of the carrier 110 from the blanks 103, 203 will be described according to an exemplary embodiment of the disclosure. As described herein, the blanks 103, 203 and respective container receiving portion 105 and handle portion 205 formed therefrom can be at least partially assembled to form the carrier 110. In this regard, the carrier 110 can be formed from a combination of blanks that includes the container blank 103 and the handle blank 103.

The container blank 103 can be inverted, e.g., such that the exterior surface 101 is positioned on a supporting surface and such that an interior surface 102 thereof is facing upwardly. A plurality of containers C can be positioned on the bottom panel 121 of the container blank 103 in a desired arrangement. As shown, the containers C can be arranged in two rows of three containers C, e.g., such that three containers C are generally linearly arranged along the portion of the bottom panel 121 located at the front portion 107 of the blank 103, and such that three containers C are generally linearly arranged along the portion of the bottom panel 121 located at the back portion 109 of the blank 103. It will be understood that a different number and/or arrangement of containers C can be provided without departing from the disclosure. In this regard, and as described further herein, the containers C can be positioned on the container blank 103 prior to the formation of the container portion 105 of the carrier 110 and prior to the formation of the handle portion 205 of the carrier 110.

The handle panels 221, 223 of the handle blank 203 can be folded at the fold line 225 in the direction of the arrow A1 and positioned into at least partial face-to-face contact. In such an arrangement, the handle panels 221, 223 can be inserted between the two rows of containers C, e.g., so as to be generally disposed along a lateral centerline of the blank 103. In some embodiments, frictional engagement of the handle panels 221, 223 with respective containers C can at least partially maintain the handle panels 221, 223 in a generally upright position relative to the bottom panel 121 of the blank 103.

The end flaps 227, 239, 251, 263 can be folded outwardly from the handle panels 221, 223 at the respective fold lines 229, 241, 253, 265 in the direction of the respective arrows A2, A3, A4, A5. Such movement of the end flaps 227, 239, 251, 263 can cause the respective distal portions 233, 245, 257, 269 thereof to at least partially fold at the respective fold lines 235, 247, 259, 271 to extend generally obliquely away from the respective base portions 231, 243, 255, 267 of the respective end flaps 227, 239, 251, 263.

The front panel 123 and the back panel 127 of the blank 103 can be folded upwardly at the respective fold lines 125, 129 in the direction of the respective arrows A6, A7. Simultaneously or thereafter, the end flaps 139, 143, 147, 151 can be folded at the respective fold lines 141, 145, 149, 153 in the direction of the respective arrows A8, A9, A10, A11.

Such movement of the end flaps 139, 143 can carry the respective gusset flaps 155, 161 foldably connected thereto into generally overlapping and/or face-to-face contact with the respective distal portions 233, 257 of the respective end flaps 227, 251. Similarly, the aforementioned movement of the end flaps 147, 151 can carry the respective gusset flaps 167, 173 foldably connected thereto into generally overlapping and/or face-to-face contact with the respective distal portions 245, 269 of the respective end flaps 239, 263.

In such arrangement, the side panel 131 can be folded upwardly at the fold line 133 in the direction of the arrow A12 so as to urge the respective distal portions 233, 257 of the respective end flaps 227, 251 to fold at the respective fold lines 235, 259 and to urge the respective gusset flaps 155, 161 to fold at the respective fold lines 157, 163 into at least partial face-to-face contact with the respective base portions 231, 255 of the respective end flaps 227, 251, with the side panel 131 positioned overlapping respective portions of the end flaps 227, 251, the gusset flaps 155, 161, and the end flaps 139, 143.

Similarly, the side panel 135 can be folded upwardly at the fold line 133 in the direction of the arrow A13 so as to urge the respective distal portions 245, 269 of the respective end flaps 239, 263 to fold at the respective fold lines 247, 271 in the direction of the arrow A13 and to urge the respective gusset flaps 167, 173 to fold at the respective fold lines 169, 175 in the direction of the arrow A13 into at least partial face-to-face contact with the respective base portions 243, 267 of the respective end flaps 239, 263, with the side panel 135 positioned overlapping respective portions of the end flaps 239, 263, the gusset flaps 167, 173, and the end flaps 147, 151.

The folded arrangement of the carrier 110 described above can be at least partially maintained via one or more applications of an adhesive such as glue. As described herein, the carrier 110 can be provided with one or more of the containers C, for example, at least partially disposed in the interior space 111 thereof, to provide a package.

The aforementioned arrangement of the carrier 110 is illustrated in FIG. 6, in which the container receiving portion 105 and handle portion 205 are assembled to form the carrier 110 having an interior space 111 in which the containers C are at least partially received, and in which the carrier 110 is divided into the front portion 106 and the back portion 108 via the positioning of the handle portion 205. The interior space 111 of the carrier 110 can be at least partially visible via the openings 179, 181 in the respective panels 123, 127.

The container receiving portion 105 and the handle portion 205 of the carrier 110 are assembled in a manner such that portions of the respective end flaps 227, 251 of the handle portion 205 are disposed between two or more portions of the container receiving portion 105 of the carrier 110, e.g., the panel 131 and the end flaps 143, 139 and/or flaps 161, 155. Similarly, portions of the respective end flaps 239, 263 of the handle portion 205 are disposed between two or more portions of the container receiving portion 105 of the carrier 110, e.g., the panel 135 and the end flaps 151, 147 and/or flaps 173, 167.

Such assembly of the carrier 110 provides for a secured assembly and attachment of the container receiving portion 105 and the handle portion 205 that allows the handle portion 205 to provide the handle features that can support the remainder of the carrier 110 upon engagement by a customer or other user. In some embodiments, the handle portion 205 of the carrier 110 can be securely attached to the container receiving portion 105 of the carrier 110 without the use of adhesives such as glue between the container receiving portion 105 and the handle portion 205. For example, and as described above, one or more portions of the handle portion 205 of the carrier 110 can be tucked, pinched, clamped, etc., between overlapping portions of the container receiving portion 105 so as to obviate the need to adhere such portions of the container receiving portion 105 and the handle portion 205 directly to one another. In this regard, in some embodiments, the container receiving portion 105 and the handle portion 205 can be free from adhesive connection to one another.

When it is desired by a customer or other user to engage the carrier 110, e.g., to lift, carry, or otherwise conveniently move or manipulate the carrier 110, the user can grasp the handle panels 221, 223, for example, adjacent the fold line 225, and insert one or more of his or her fingers through the aligned handle openings 275, 281. In some embodiments, the user can curl his or her fingers to cause the handle flaps 277, 283 to fold at the aligned fold lines 279, 285, and form a two-ply structure to be positioned between the user's hand and the respective handle panel 121, 123, for example, for comfort (e.g., to avoid pinching or digging), to avoid stresses or tearing of one or more portions of the carrier 110, etc. Together with the upper portions of the handle panels 221, 223, the handle flaps 277, 283 can provide a four-ply structure about which the user can grasp the carrier 110. In this regard, the handle openings 273, 279 and associated features, the handle flaps 275, 281 and associated features, and upper portions of the handle panels 221, 223 can together form the handle 113 of the carrier 110.

It will be understood that one or more portions of the carrier 110 can have a different configuration without departing from the disclosure.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a container receiving portion comprising a plurality of panels extending at least partially around an interior space of the carrier and a plurality of end flaps foldably connected to a respective panel of the plurality of panels, the plurality of panels of the container receiving portion comprising a bottom panel, a front panel, a back panel, and at least one side panel; and a handle portion comprising a plurality of panels and a plurality of end flaps foldably connected to a respective panel of the plurality of panels of the handle portion, the plurality of panels of the handle portion comprising a front handle panel and a back handle panel;

wherein at least one end flap of the plurality of end flaps of the handle portion is positioned between the at least one side panel and at least one end flap of the plurality of end flaps of the container receiving portion to form an adhesive-less attachment between the container receiving portion and the handle portion.

2. The carrier of claim 1, wherein the plurality of end flaps of the container receiving portion comprises at least one side end flap foldably connected to one of the front panel and the back panel.

3. The carrier of claim 2, wherein the at least one end flap of the plurality of end flaps of the handle portion is positioned between the at least one side end flap and the at least one side panel.

4. The carrier of claim 3, wherein the container receiving portion further comprises a plurality of gusset flaps foldably connected to a respective panel of the plurality of panels of the container receiving portion.

5. The carrier of claim 4, wherein the plurality of gusset flaps comprises at least one gusset flap foldably connected to each of the at least one side end flap and the one of the front panel and the back panel.

6. The carrier of claim 5, wherein the at least one end flap of the plurality of end flaps of the handle portion comprises a base portion foldably connected to a distal portion, the at least one side end flap and the at least one gusset flap of the container receiving portion are positioned between the base portion and the distal portion of the at least one end flap of the plurality of end flaps of the handle portion.

7. The carrier of claim 6, wherein the distal portion of the at least one end flap of the plurality of end flaps of the handle portion is in at least partial face to face contact with each of the at least one side panel and the at least one gusset flap of the container receiving portion.

8. The carrier of claim 7, wherein the at least one side end flap of the container receiving portion is in at least partial face-to-face contact with the base portion of the at least one end flap of the plurality of end flaps of the handle portion.

9. The carrier of claim 6, wherein the at least one side panel is a first side panel of the container receiving portion and the plurality of panels of the container receiving portion further comprises a second side panel, the at least one side end flap is a first side end flap foldably connected to the one of the front panel and the back panel of the container receiving portion, the plurality of end flaps of the container receiving portion further comprises a second side end flap foldably connected to the one of the front panel and the back panel of the container receiving portion, the at least one end flap of the plurality of end flaps of the handle portion is a first attachment end flap foldably connected to one of the front handle panel and the back handle panel, the plurality of end flaps of the handle portion further comprises a second attachment end flap foldably connected to the one of the front handle panel and the back handle panel, and the second attachment end flap is positioned between the second side panel and the second side end flap of the container receiving portion to attach the container receiving portion and the handle portion.

10. The carrier of claim 9, wherein the at least one gusset flap of the container receiving portion is a first gusset end flap foldably connected to each of the first side panel and the first side end flap, the at least one gusset flap further comprises a second gusset flap, the second attachment end flap of the handle portion comprises a base portion foldably connected to a distal portion, and the second side end flap and the second gusset flap of the container receiving portion are positioned between the base portion and the distal portion of the second attachment end flap of the handle portion.

11. A combination of blanks for forming a carrier for holding a plurality of containers, the combination comprising:

a container blank for forming a container receiving portion extending around an interior space of the carrier formed from the container blank and a handle blank, the container blank comprising a plurality of panels and a plurality of end flaps foldably connected to a respective panel of the plurality of panels, the plurality of panels of the container blank comprising a bottom panel, a front panel, a back panel, and at least one side panel; and the handle blank for forming a handle portion of the carrier formed from the container blank and the handle blank, the handle blank comprising a plurality of panels and a plurality of end flaps foldably connected to a respective panel of the plurality of panels of the handle blank, the plurality of panels of the handle blank comprising a front handle panel and a back handle panel, at least one end flap of the plurality of end flaps of the handle blank is for being positioned between the at least one side panel and at least one end flap of the plurality of end flaps of the container blank to form an adhesive-less attachment between the container receiving portion and the handle portion when the carrier is formed from the container blank and the handle blank.

12. The combination of claim 11, wherein the plurality of end flaps of the container blank comprises at least one side end flap foldably connected to one of the front panel and the back panel.

13. The combination of claim 12, wherein the container blank further comprises a plurality of gusset flaps foldably connected to a respective panel of the plurality of panels of the container blank.

14. The combination of claim 13, wherein the plurality of gusset flaps comprises at least one gusset flap foldably connected to each of the at least one side end flap and the one of the front panel and the back panel.

15. The combination of claim 14, wherein the at least one end flap of the plurality of end flaps of the handle blank comprises a base portion foldably connected to a distal portion, the at least one side end flap and the at least one gusset flap of the container blank are for being positioned between the base portion and the distal portion of the at least one end flap of the plurality of end flaps of the handle blank when the carrier is formed from the container blank and the handle blank.

16. The combination of claim 15, wherein the at least one side panel is a first side panel of the container blank and the plurality of panels of the container blank further comprises a second side panel, the at least one side end flap is a first side end flap foldably connected to the one of the front panel and the back panel of the container blank, the plurality of end flaps of the container blank further comprises a second side end flap foldably connected to the one of the front panel and the back panel of the container blank, the at least one end flap of the plurality of end flaps of the handle blank is a first attachment end flap foldably connected to one of the front handle panel and the back handle panel, the plurality of end flaps of the handle blank further comprises a second attachment end flap foldably connected to the one of the front handle panel and the back handle panel, and the second attachment end flap is for being positioned between the second side panel and the second side end flap of the container blank to attach the container receiving portion formed from the container blank and the handle portion formed from the handle blank when the carrier is formed from the container blank and the handle blank.

17. The combination of claim 16, wherein the at least one gusset flap of the container blank is a first gusset end flap foldably connected to each of the first side panel and the first side end flap, the second attachment end flap of the handle blank comprises a base portion foldably connected to a distal portion, and the second side end flap and the second gusset flap of the container blank is for being positioned between the base portion and the distal portion of the second attachment end flap of the handle blank when the carrier is formed from the container blank and the handle blank.

* * * * *